US006492003B1

(12) United States Patent
Ochiai et al.

(10) Patent No.: US 6,492,003 B1
(45) Date of Patent: Dec. 10, 2002

(54) IMAGE RECORDING SHEET AND MATERIAL FOR FORMING COVERING LAYER OF IMAGE RECORDING SHEET

(75) Inventors: Hiroshi Ochiai, Ebina (JP); Yoshinari Yasui, Ebina (JP); Hiroshi Miyamura, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/456,292

(22) Filed: Dec. 8, 1999

(30) Foreign Application Priority Data

Apr. 10, 1998 (JP) ..... 10-099057

(51) Int. Cl.[7] ..... B41M 5/00
(52) U.S. Cl. ..... 428/195; 156/235; 428/213
(58) Field of Search ..... 428/195, 213; 156/235

(56) References Cited

U.S. PATENT DOCUMENTS 4,869,941 A 9/1989 Ohki ..... 428/40
5,322,832 A 6/1994 Takeyama et al. ..... 503/227

FOREIGN PATENT DOCUMENTS

EP 0 253 338 A2 1/1988

*Primary Examiner*—Bruce H. Hess
(74) *Attorney, Agent, or Firm*—Fitzpatrick, Cella, Harper & Scinto

(57) ABSTRACT

The present invention relates to an image recording sheet and a covering-layer-forming material of the image recording sheet for recording a predetermined image by an image recording apparatus of the ink jet method or the like, and provides the image recording sheet and the covering-layer-forming material of the image recording sheet that permit a covering layer to be formed on an ink receiving layer easily and at low cost, that permit the covering layer to cover the ink receiving layer firmly, that are free of occurrence of the damage such as peeling of the covering layer off the ink receiving layer or the like, and that permit recording to a high-quality and analog-look image, i.e., an images like a silver-salt photograph. For realizing it, the present invention provides the image recording sheet used for recording the image in the ink receiving layer formed on a surface of a base material by the image recording device of the ink jet method or the like and covering surfaces of the ink receiving layer and image by a covering layer to record the predetermined image, wherein the covering layer is formed by transferring a covering layer formed in a separable state on a release sheet, directly onto the ink receiving layer, or with a transfer auxiliary layer in between, or with a preformed covering layer of the same material as the covering layer in between.

6 Claims, 3 Drawing Sheets

(a)

(b)

IMAGE RECORDING SHEET AND MATERIAL FOR FORMING COVERING LAYER OF IMAGE RECORDING SHEET

TECHNICAL FIELD

The present invention relates to an image recording sheet and a material for forming a covering layer of the image recording sheet and, more particularly, to an image recording sheet for recording of a predetermined image by image recording apparatus of the ink jet method etc., and a material for forming a covering layer of the image recording sheet.

BACKGROUND ART

In general, many image recording sheets are used for recording the predetermined image, for example, by the image recording apparatus of the ink jet method and the other methods.

On the conventional image recording sheets of this type, in order to record a high-quality image on the sheet surface from an original picture of high resolution, there were demands for formation of an ink receiving layer capable of preventing diffusion of ink having a property of diffusing on the sheet surface and thus forming a digital-look image.

For meeting the demands, it was conventional practice to form the ink receiving layer of a predetermined thickness whose principal components are boehmite having an average particle size of not more than 0.1 $\mu$m and alumina microparticles, on a surface of a base material.

In order to protect the ink image recorded in the ink receiving layer, it was also conventional practice to cover the surface of the ink receiving layer by a covering layer made of an appropriate covering material.

The conventional image recording sheets described above, however, had the following disadvantages.

Namely, the conventional methods for forming the covering layer over the ink receiving layer normally involved coating the ink receiving layer with the covering layer and thereafter drying it, thereby completing the covering layer, and thus had the problems of long time necessary for the formation of the covering layer, and high cost.

Since the average particle size of boehmite was very small, the base material was coated with a sol form of boehmite synthesized with an appropriate binder; during the coating there occurred such incidents that the ink receiving layer cracked and that the image recording shoot itself curled, which made use thereof in image recording impossible. In order to stabilize the coating layer of boehmite on the surface of the base material, the coating layer also needed to be preliminarily baked at about 150° C., and the heating resulted in leaving unevenness of the image recording sheet itself, so as to make use thereof in image recording impossible. The coating layer of boehmite absorbed cigarette smoke etc. to yellow, so as to become unapplicable to image recording. Further, the coating layer of boehmite absorbed the ink well to prevent diffusion of the ink and be able to form the digital-look image; on the other hand, the ink remained in units of sizes of ink dots, so that it failed to record an analog-look image, i.e., an image like a silver-salt photograph.

DISCLOSURE OF THE INVENTION

The present invention has been accomplished in view of these aspects and overcame the aforementioned problems of prior art, and an object of the present invention is to provide an image recording sheet and a material for forming a covering layer of the image recording sheet by which the covering layer can be formed easily and at low cost on the image reception layer, by which the covering layer can be made to firmly cover the ink receiving layer, in which there occurs none of damage such as peeling of the covering layer off the ink receiving layer or the like, by which it is possible to record a high-quality and analog-look image, i.e., an image like a silver-salt photograph, by which the gloss can be adjusted, and which are excellent in water resistance, weather resistance, and so on, easy in production, and low in cost.

In order to accomplish the above object, the inventors conducted intensive and extensive research and found out the following, so as to accomplish the present invention; in cases where the covering layer is formed by transferring it onto the ink receiving layer and where a material of the covering layer and a material of the ink receiving layer are congenial to each other, if the covering layer is formed by transferring the covering layer formed on a release sheet onto the surface of the ink receiving layer, the covering layer can be made to cover the ink receiving layer easily and firmly, without occurrence of the damage such as peeling of the covering layer off the ink receiving layer or the like; in cases where a transfer auxiliary layer made of a material different from the two layers and congenial to them is preliminarily formed to cover at least one of them and where the covering layer is transferred onto the surface of the ink receiving layer with the transfer auxiliary layer in between, the covering layer can be made to cover the ink receiving layer easily and firmly, as above, without occurrence of the damage such as peeling of the covering layer off the ink receiving layer or the like; in cases where the same material as that for forming the covering layer is preliminarily formed as a thin layer on the surface of the ink receiving layer, irrespective of the congeniality of the two layers and where the covering layer formed on the release sheet is transferred thereonto, the covering layer can be made to cover the ink receiving layer easily and firmly, without occurrence of the damage such as peeling of the covering layer off the ink receiving layer or the like. Further, the inventors also found out the following, so as to complete the present invention; an excellent image recording sheet can be obtained by using a swelling resin and a solid component as components of the ink receiving layer and adjusting a mixture rate of the two components, and the maximum size and average grain size of the solid component.

Namely, an image recording sheet according to the present invention is an image recording sheet used for recording an image in an ink receiving layer formed on a surface of a base material by an image recording device of an ink jet method or the like and covering surfaces of the ink receiving layer and the image by a covering layer to record a predetermined image, wherein said covering layer is formed by transferring a covering layer, which is formed in a separable state on a release sheet, onto said ink receiving layer. Since in the image recording sheet formed as described above the material of the ink receiving layer and the material of the covering layer are congenial to each other, the covering layer formed in the separable state on the transfer sheet of the covering-layer-forming material to the ink receiving layer can be transferred directly onto the surface of the ink receiving layer, whereby the ink receiving layer and the directly transferred covering layer congenial to each other can adhere to each other with large adhesive strength.

Another image recording sheet according to the present invention is an image recording sheet used for recording an image in an ink receiving layer formed on a surface of a base material by an image recording device of an ink jet method or the like and covering surfaces of the ink receiving layer and the image by a covering layer to record a predetermined image, wherein a transfer auxiliary layer is preliminarily provided to cover at least one of a surface of a covering layer, which is formed in the separable state on a release sheet, and the surface of said ink receiving layer and the covering layer is formed by transferring said covering layer onto said ink receiving layer with said transfer assist layer in between. With the image recording sheet formed as described above, the covering layer can be transferred onto the surface of the ink receiving layer with interposition of the transfer auxiliary layer made of the material different from the material of the ink receiving layer and the material of the covering layer and congenial to the both and preliminarily formed to cover at least one of the both. This permits the covering layer to cover the ink receiving layer easily and firmly with the transfer auxiliary layer in between and nullifies occurrence of the damage such as peeling of the covering layer off the ink receiving layer or the like. As a consequence, the ink receiving layer can be protected well even if the whole covering layer is formed in small thickness. In this way, according to Claim 2, the ink receiving layer and the covering layer both can adhere to each other firmly, irrespective of the congeniality between the material of the ink receiving layer and the material of the covering layer. Accordingly, this is extremely effective when applied to a combination of such materials that the covering layer transferred is readily peeled off the ink receiving layer because of poor congeniality of them.

Another image recording sheet according to the present invention is an image recording sheet used for recording an image in an ink receiving layer formed on a surface of a base material by an image recording device of an ink jet method or the like and covering surfaces of the ink receiving layer and the image by a covering layer to record a predetermined image, wherein said covering layer is formed by preliminarily forming a thin preformed covering layer of the same material as the covering layer, on the surface of said ink receiving layer and transferring a covering layer, which is formed in a separable state on a release sheet, onto said preformed covering layer. With the image recording sheet formed as described above, since the preformed covering layer made of the same material as the covering layer is preliminarily formed as a thin layer on the surface of the ink receiving layer of the image recording sheet, the covering layer formed in the separable state on the transfer sheet of the covering-layer-forming material can be transferred onto the preformed covering layer formed on the ink receiving layer so as to cover it. This permits the transferred covering layer to be firmly integrated with the preformed covering layer on the ink receiving layer and thus increases the adhesive strength of the whole covering layer to the ink receiving layer, whereby the covering layer can be made to cover the ink receiving layer easily and firmly, without occurrence of the damage such as peeling of the covering layer off the ink receiving layer or the like. As a consequence, the ink receiving layer can be protected well even if the whole covering layer is formed in small thickness. In this case, the material of the preformed covering layer can be the same as the material of the covering layer directly transferred onto the preformed covering layer, but the material of the preformed covering layer may be different, for example, from the material of the part of the covering layer not transferred directly onto the preformed covering layer. In this way the present invention permits the ink receiving layer and the covering layer to adhere to each other firmly, irrespective of the congeniality between the material of the ink receiving layer and the material of the covering layer. Accordingly, it is extremely effective when applied to a combination of such materials that the transferred covering layer is peeled readily off the ink receiving layer because of poor congeniality of them.

The image recording sheet according to the present invention is also characterized in that the ink receiving layer has a composition in which 10 to 300 parts by weight, of a solid component are mixed per 100 parts by weight of a swelling resin component, and in that the solid component has a maximum size equal to a half or less of a thickness of the ink receiving layer, and an average grain size of 1 to 10 $\mu$m. According to the invention formed as described, the ink can be received properly, where the mixture rate of the solid component to the swelling resin as components of the ink receiving layer is 10 to 300 parts by weight per 100 parts by weight of the swelling resin component; pinholes can be prevented from appearing in the ink receiving layer, where the maximum size of the solid component is a half or less of the thickness of the ink receiving layer; a high-quality and analog-look image, i.e., an image like a silver-salt photograph can be recorded and the gloss thereof can be adjusted, where the average grain size of the solid component is 1 to 10 $\mu$m.

The image recording sheet according to the present invention is characterized in that the solid component is silica. The invention formed as described can make the image recording sheet more excellent.

The image recording sheet according to the present invention is also characterized in that the material forming the covering layer is latex. The invention formed as described permits the image formed in the ink receiving layer to be covered by the covering layer of transparent latex, so as to make the image look like a photograph, whereby the quality of the image can be improved greatly.

The covering-layer-forming material of the image recording sheet according to the present invention is one wherein the covering layer is formed in a separable state on a release sheet. According to the present invention formed as described, the covering layer can be stripped away from the release sheet to be transferred onto the surface of the ink receiving layer so as to cover it.

The covering-layer-forming material of the image recording sheet according to the present invention is characterized in that the material forming the covering layer is the latex. According to the invention formed as described, the image formed in the ink receiving layer can be covered by the covering layer of the transparent latex, so as to make the image look like a photograph, whereby the quality of the image can be improved greatly.

Since the image recording sheet and the covering-layer-forming material of the image recording sheet according to the present invention are constituted and act as described above, they have the following effects without occurrence of the problems as encountered in prior art; the covering layer can be formed easily and at low cost on the ink receiving layer, the covering layer can be made to cover the ink receiving layer firmly, they are free of the damage such as peeling of the covering layer off the ink receiving layer or the like, they permit recording of a high-quality and analog-look image, i.e., an image like a silver-salt photograph, they permit adjustment of gloss, they have excellent water resistance, weather resistance, etc., their production as easy, the cost is low, and so on.

Figure 3:
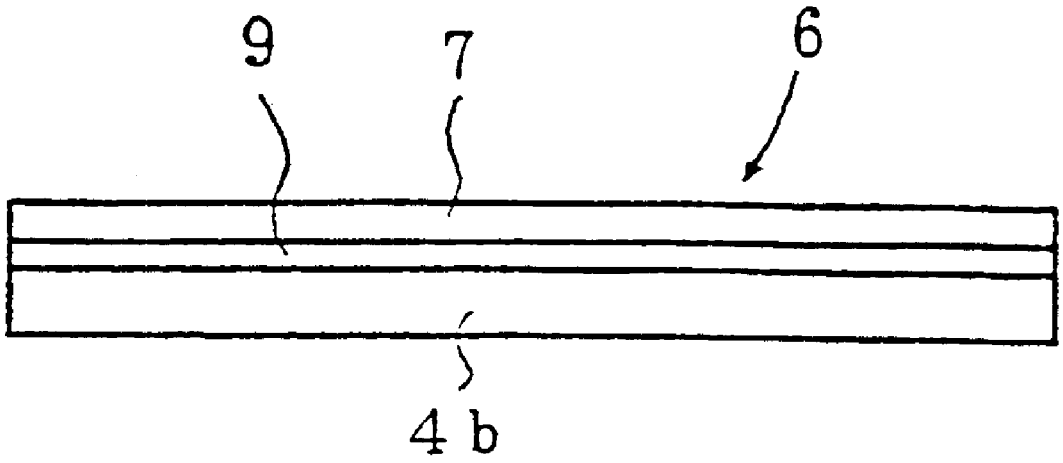
Figure 3:
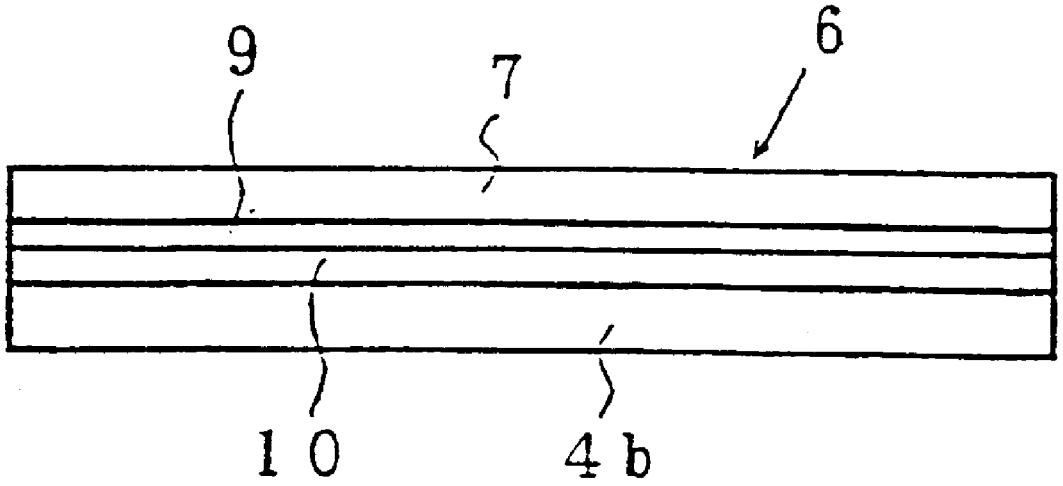
Figure 4:
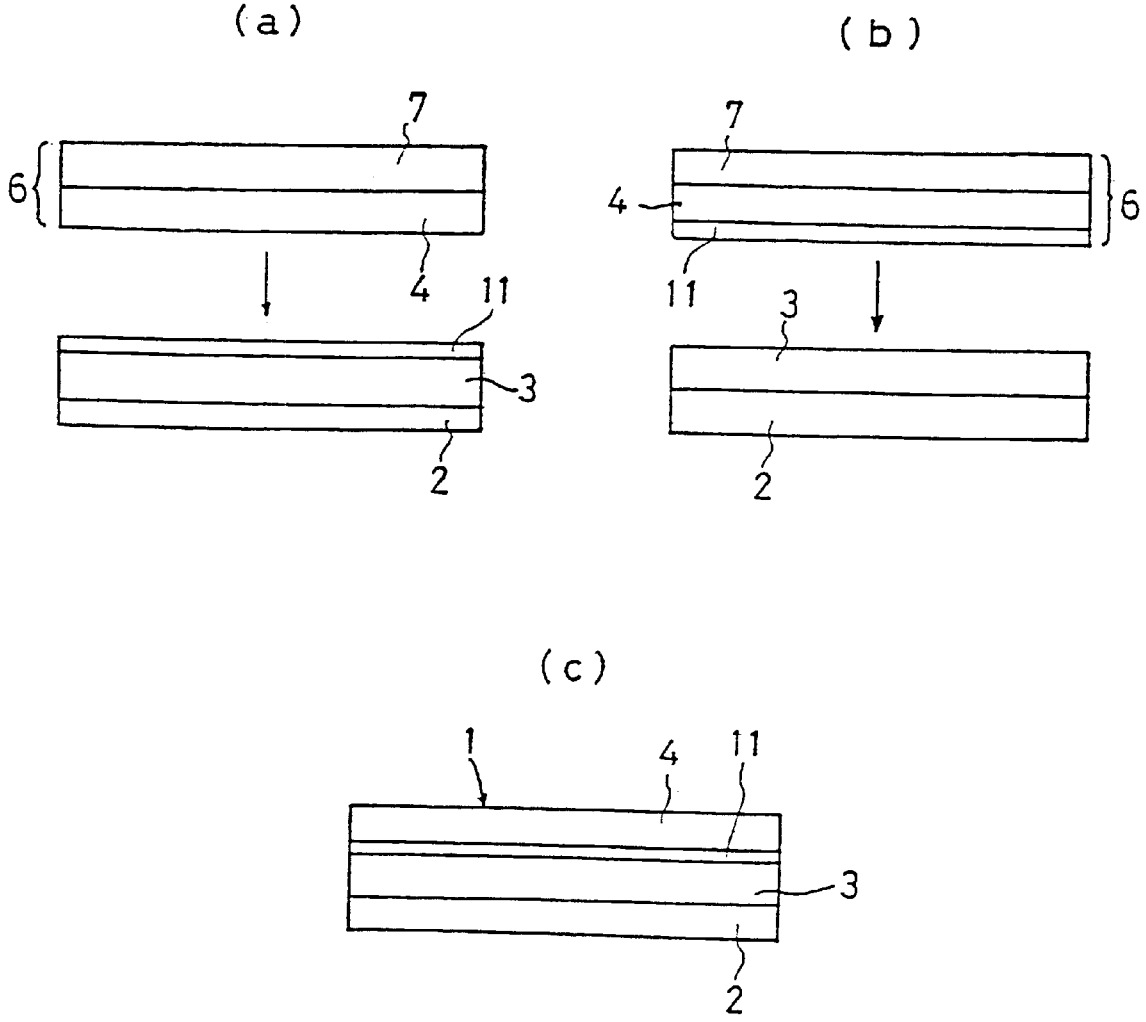

(a) and (b) of FIG. 3 are schematic, sectional diagrams to show an embodiment of the material for forming the covering layer of the image recording sheet; and (a) to (c) of FIG. 4 are schematic, sectional diagrams to show another embodiment of the image recording sheet.

BEST MODE FOR CARRYING OUT THE INVENTION

Embodiments of the present invention will be described below by reference to FIG. 1 to FIG. 4.

Figure 1:
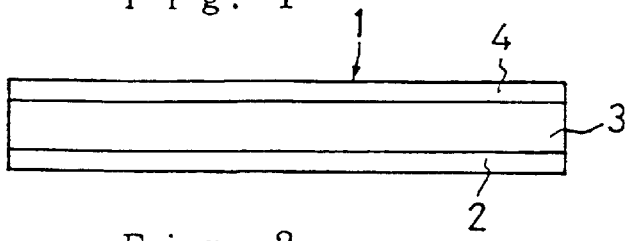
FIG. 1 is a schematic, sectional diagram to show an embodiment of the image recording sheet according to the present invention.

FIG. 1 shows an image sheet produced by use of an embodiment of the image recording sheet and the material for forming the covering layer of the image recording sheet according to the present invention, this image recording sheet 1 has the sheetlike base 2, and the ink receiving layer 3 is formed on the upper surface side of this base 2. The ink to form an image is directly recorded onto this ink receiving layer 3 by the image recording apparatus of the ink jet method and the covering layer 4 is formed on the surface thereof to complete recording of the image.

The image recording sheet 1 of the present invention will be explained along the production steps illustrated in FIG. 2.

Figure 2:
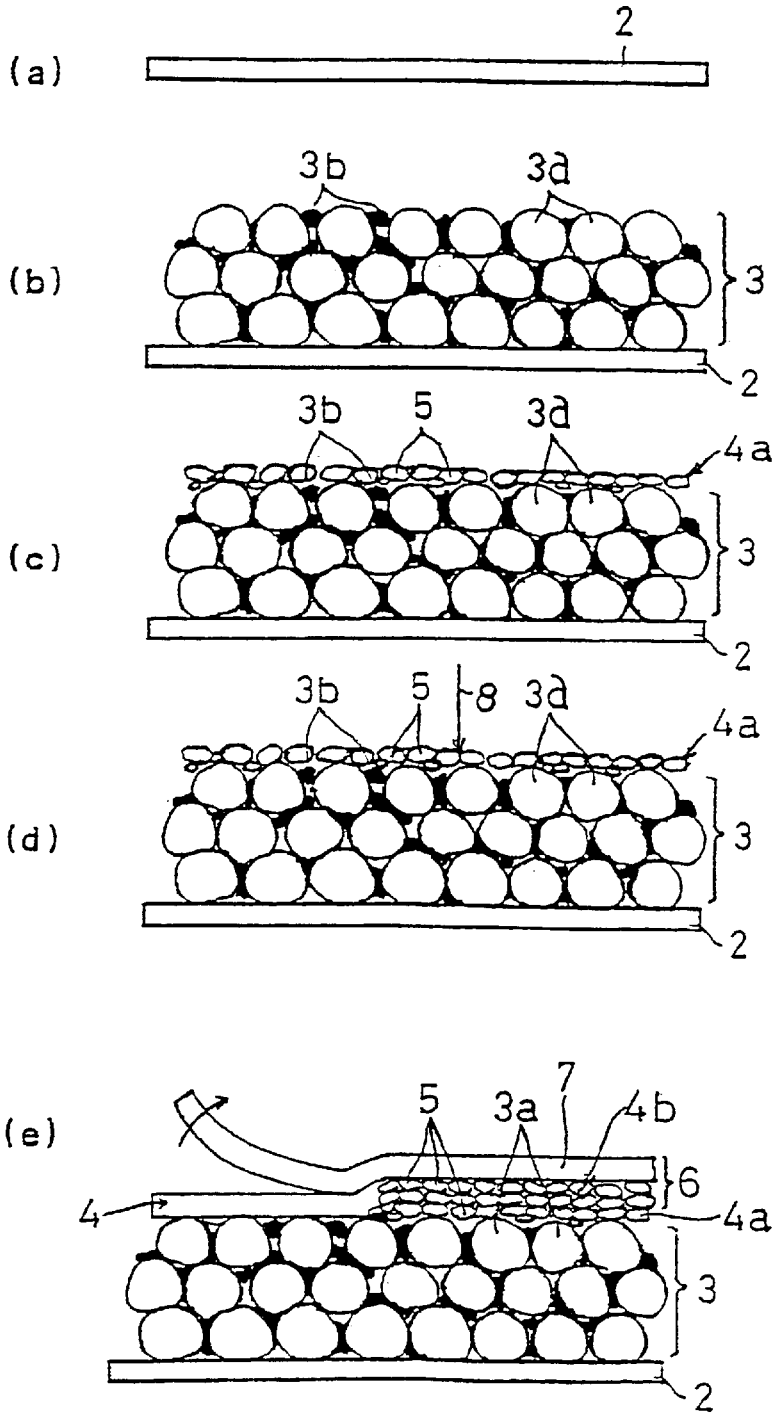
FIG. 2 is enlarged sectional diagrams to show an embodiment of the image recording sheet according to the present invention in the order of production steps thereof.

The base material 2 is made, for example, of a sheetlike material such as synthetic resin, fabric, or paper, as illustrated in (a) of FIG. 2.

The image reception layer 3 is formed by coating the surface of the base material 2 with a liquid mixture of solid component 3*a*, swelling resin component 3*b*, and a solvent and drying it, as illustrated in (b) of FIG. 2, and the ink receiving layer 3 after the drying has the composition of mixture of the solid component 3*a* and swelling resin component 3*b*. A mixture rate of the solid component 3*a* is 10 to 300 parts by weight per 100 parts by weight of the swelling resin component 3*b*. This solid component 3*a* has the maximum size of a half or less of the thickness of the ink receiving layer 3 and the average grain size of 1 to 10 $\mu$m. The swelling resin component 3*b* can be any material that demonstrates the function as a binder for the solid component 3*a* and that demonstrates the function to absorb the ink, and is preferably a polymer material having a water absorbing property. Specific examples of the swelling resin component 3*b* are trade names: NS-120XK, NS-282LK, and NS-141LX available from Takamatsu Yushi K.K. The solid component 3*a* can be, for example, one selected from ceramic materials such as silica, alumina, and the like, and solid materials such as calcium carbonate and the like. For example, in the case of silica being used, it can be any silica produced by either one synthesis method selected from the dry process (also called the vapor phase process), the wet process (also called the water glass process), and the sol-gel process. Among them, particularly, the silica of the gel type by the wet process is most suitable for the solid component 3*a* for ink jet. The shape of the solid component 3*a* can be any shape, for example, the spherical shape, the needlelike shape, the platelike shape, the cubic shape, and so on. The reason why the rate of this solid component 3*a* per 100 parts by weight of the swelling resin component 3*b* is defined as described above is that the ink diffusion effect will become weaker below 10 parts by weight and the film strength as the ink receiving layer 3 will become weaker against the base material 2 above 300 parts by weight. When the maximum size of the solid component 3*a* is a half or less of the thickness of the ink receiving layer 3, there are no pinholes formed in the ink receiving layer 3, so as to permit recording of an image with high quality. The reason why the average grain size of the solid component 3*a* is 1 to 10 $\mu$m is as follows; in the range below 1 $\mu$m the ink absorbing property will be degraded and cracks will appear in the ink receiving layer 3 when baked during the aforementioned drying in order to stably fix the ink receiving layer 3 to the base material 2; in the range above 10 $\mu$m the degree of diffusion of ink will become too large to record the image with high quality. The thickness of the ink receiving layer 3 is preferably about 20 to 50 $\mu$m. If the thickness of the ink receiving layer 3 is smaller than 20 $\mu$m the ink absorbing property will be too poor to record the image with high quality; if it is larger than 50 $\mu$m there could occur the damage of cracking or the like in the ink receiving layer 3 when the image recording sheet 1 is curled. The ink receiving layer 3 may also be formed by transferring it onto the base material 2.

The covering layer 4 is formed in such a manner that a separable covering layer 4*b* formed on a transfer sheet 7 of covering-layer-forming material 6, as illustrated in (e) of FIG. 2, is transferred onto a preformed covering layer 4*a* of the same material as the covering layer 4, preliminarily formed as a thin film on the surface of the ink receiving layer 3, as illustrated in (c) of FIG. 2. In the present embodiment, the covering layer 4 is made of covering material 5 with durability such as latex, a thermoplastic adhesive, or the like.

Describing it according to the order of steps, the preformed covering layer 4*a* is formed by applying a liquid mixture of the covering material 5 with durability, Such as the latex or the like, with a solvent onto the surface of the ink receiving layer 3 formed as described above, to form a thin film, as illustrated in (c) of FIG. 2, and drying it. The covering material 5 can be either of materials that have the properties of water resistance, weather resistance, etc., including UV-cutting materials having resistance to UV, and can be selected properly therefrom according to the use of the image recording sheet 1 or the like. For enhancing the visibility of the recorded image, a material with transparency, for example transparent latex or the like, is suitably applicable as the covering material 5. The other transparent covering materials than the transparent latex are, for example, hot melt materials such as Vinyblan (trade name) available from Nisshin Kagaku K.K. This hot melt material is not sticky at ordinary temperature, becomes transparent and adhesive under heat and pressure, and is preferably used as a transferable covering material. The covering material 5 can also be one obtained by encapsulating the latex in heat-resistant fine capsules, and the fine capsules are crushed on the occasion of heat compression with the covering layer 4*b* to push the covering material 5 out and make it integral with the preformed covering layer 4*a*. A semitransparent or chromatic color covering material 5 may also be used as occasion may demand.

A preferred thickness of this preformed covering layer 4*a* is one enough to assure sufficient adhesion to the ink receiving layer 3 for the whole of the covering layer 4 formed by being integrated with the covering layer 4*b* transferred in the next step (for example, the thickness of one molecule to several molecules of the covering material 5:0.1 to 5 $\mu$m) and one not to inhibit penetration of the ink made to penetrate through this preformed covering layer 4*a* into the ink receiving layer 3. In the preformed covering layer 4*a* formed in this way, there are void spaces between particles of the covering material 5 through which the ink can pass into the side of the ink receiving layer 3.

The image, recording sheet 1 in which the ink receiving layer 3 and preformed covering layer 4*a* are formed in order on the surface of the base material 2 as described above can be provided in that state for end users. In this case, the image recording sheet 1 is provided preferably in a cut form of a predetermined size or in a roll form of a long sheet of a predetermined width.

Image recording is effected in such a way that the ink 8 is discharged (or ejected) based on image data from the ink jet recording apparatus toward the preformed covering layer 4*a* of the image recording sheet 1, as illustrated in (d) of FIG. 2. The ink 8 deposited on the preformed covering layer 4*a* passes between particles of the covering material 5 adjacent to each other to go into the underlying ink receiving layer 3. After that, it penetrates between the solid component 3*a* and the swelling resin component 3*b* adjacent to each other in the ink receiving layer 3. Namely, the ink 8 passes between particles of the covering material 5 while maintaining the sizes of dots discharged from the ink jet recording apparatus, reaches the ink receiving layer 3 and then penetrates in the direction of the thickness of the ink receiving layer 3, and also slightly penetrates and diffuses in the direction perpendicular to the direction of the thickness at the same time, thereby permitting recording of an analog-look image. This is because the percentage of the solid component 3*a* and the swelling resin component 3*b* forming the ink receiving layer 3, the average grain size of the solid component 3*a*, the thickness of the ink receiving layer 3, etc. are determined as described above. The ink 8 can be any ink that can be used for ink jet and is preferably one congenial to the solid component 3*a* and the swelling resin component 3*b* of the ink receiving layer 3.

Finally, as illustrated in (e) of FIG. 2, the covering layer 4*b* separately formed on the transfer sheet 7 of the covering-layer-forming material 6 is laminated on the surface of the preformed covering layer 4*a*. Namely, the covering layer 4*b* is overlaid on the surface of the preformed covering layer 4*a* and the whole is made successively to pass between heat press roll not illustrated from left to right in the same figure. This makes the covering material 5 of the same material in the preformed covering layer 4*a* and the covering layer 4*b* fused to stick to each other firmly into an integral covering layer 4 and, particularly, the covering material 5 of the preformed covering layer 4*a* penetrates into between the solid component 3*a* and the swelling resin component 3*b* of the ink receiving layer 3 to effect transfer formation with large adhesion to the ink receiving layer 3. Then the release sheet 7 is peeled away from the covering layer 4, thus forming the image recording sheet 1 illustrated in FIG. 1.

The covering-layer-forming material 6 formed in this way may also be provided in its single state for the end users. In this case, the covering-layer-forming material 6 is preferably provided in a cut form of a predetermined size or in a roll form of a long sheet of a predetermined width.

The thickness of the covering layer 4 of the integrated form is preferably at least one enough to protect the image formed in the ink receiving layer 3.

Since the preformed covering layer 4*a* of the same material as the covering layer 4 is preliminarily formed as a thin film on the surface of the ink receiving layer 3 of the image recording sheet 1 as described above, the present embodiment can achieve the following; when the covering layer 4*b* separately formed on the transfer sheet 7 of the covering-layer-forming material 6 is transferred onto it, the preformed covering layer 4*a* is firmly integrated with the covering layer 4*b* thus transferred, so as to increase the adhesion of the whole of the covering layer 4 to the ink receiving layer 3, permit the covering layer 4 to cover the ink receiving layer 3 easily and firmly, and cause none of damage such as peeling of the covering layer 4 off the ink receiving layer 3 or the like. Namely, the image recording sheet 1 becomes excellent in durability, i.e., in water resistance, weather resistance, ultraviolet resistance, and so on. This permits the ink receiving layer 3 to be protected well even if the whole of the covering layer 4 is formed in small thickness. Since the strong covering layer can be formed easily, the cost becomes very low. Specifically, the cost is approximately one fifth of that of the ordinary image recording sheets for ink jet and approximately one third of that of photographic paper for silver-salt photography.

When the material for the covering layer 4 is the transparent latex, the image formed in the ink receiving layer 3 can be covered by the transparent covering layer 4 and the gloss of the image can be enhanced so as to make the image look like a photograph, thus greatly improving the quality of the image.

In the present invention, the material illustrated in (b) of FIG. 2 in which the ink receiving layer 3 is formed on the base material 2 can be of any constitution.

On the other hand, as in the present embodiment, the ink 8 can be received properly where the mixture rate of the solid component 3*a* to the swelling resin component 3*b* as components of the ink receiving layer 3 is 10 to 300 parts by weight per 100 parts by weight of the swelling resin component 3*b*; pinholes can be prevented from, occurring in the ink receiving layer 3 where the maximum size of the solid component 3*a* is a half or less of the thickness of the ink receiving layer 3; a high-quality and analog-look image, i.e., an image like a silver-salt photograph can be recorded and the gloss can be adjusted where the average grain size of the solid component 3*a* is 1 to 10 $\mu$m. When the thickness of the ink receiving layer 3 is 20 to 50 $\mu$m, the ink 8 can be received more properly and the image recording sheet 1 can be obtained with extremely excellent durability while the covering layer 4 imparts the water resistance, weather resistance, and so on thereto. Since the solid component 3*a* is silica and the covering material 6 of the covering layer 4 is the transparent latex, the more excellent image recording sheet 1 can be obtained. Further, the degree of gloss can be adjusted by adjusting the average grain size of silica of the solid component 3*a*; for example, when the average grain size of silica is smaller than 3 $\mu$m, the image recording sheet 1 can be made to record an image with gloss; when it is larger than 5 $\mu$m, the image recording sheet 1 can be made to record an image without gloss. In order to impart glossiness with more certainty, an appropriate glossing layer may be provided between the ink receiving layer 3 and the covering layer 4.

Although in the above embodiment the preformed covering layer, 4*a* is formed on the surface of the ink receiving layer 3, this preformed covering layer 4*a* can also be omitted.

In other words, where the material of the ink receiving layer 3 and the material of the covering layer 4 to be transferred thereonto are of good congeniality in wettability, compatibility, and so on, when the covering layer 4 formed on the release sheet 7 is transferred onto the surface of the ink receiving layer 3, the covering layer 4 can be made to cover the ink receiving layer 3 easily and firmly, without occurrence of the damage such as peeling of the covering layer 4 off the ink receiving layer 3 or the like. It can also enjoy the same operational effect as the aforementioned embodiment.

The covering-layer-forming material 6 will be explained in further detail by reference to FIG. 3

(a) of FIG. 3 shows an embodiment of the covering-layer-forming material 6, in which the covering layer 4*b* of the latex or the like is stacked on the release sheet 7 of a material such as PET film or the like with a release layer 9 in between, whereby the covering layer 4*b* is formed so as to be separable from the release sheet 7 thanks to the release layer 9. When the covering layer 4*b* is attached directly to the release sheet 7 in a separable state, the release layer 9 can be excluded. When the surface of the release sheet 7 is flat, the surface of the covering layer 4*b* transferred onto the ink receiving layer 3 also becomes flat and thus is provided with gloss. When the surface of the release sheet 7 is provided with fine unevenness, the surface of the covering layer 4*b* transferred onto the ink receiving layer 3 is also provided with fine unevenness, so as to undergo a glare-proof treatment. It is easy to write characters or print them in the part subject to this glare-proof treatment. Therefore, when flat portions and uneven portions are provided at desired positions in the surface of the release sheet 7, flat portions and uneven portions can be formed in designed arrangement at desired positions in the surface of the covering part 4 of the image recording sheet 1. Further, it can also be contemplated that the surface of the heat press roll, not illustrated, for pressing and heating the release sheet 7 during the transfer is embossed in a predetermined uneven pattern and the surface of the covering layer 4 to be transferred during the transfer is pressed in the uneven pattern through the release sheet 7 and release layer 9, so as to realize the design arrangement of the flat portions and uneven portions at the desired positions in the surface of the covering part 4 of the image recording sheet 1. If the surface of the aforementioned heat roll is provided with releasability by coating it with silicone resin or fluororesin, the preformed covering layer 4*a* and ink receiving layer 3 can be prevented from being mistransferred onto the heat press roll even if the base material 2 side and the covering-layer-forming material 6 subject to pressure and heat by the heat press roll are shifted in the direction of the width from their appropriate relative positions to bring the preformed covering layer 4*a* formed on the surface of the ink receiving layer 3 on the base material 2 side into direct contact with the heat press roll. The transfer of the covering layer 4*b* onto the preformed covering layer 4*a* can be carried out, not only by bringing the base material 2 side into direct close contact with the covering-layer-forming material 6 side as illustrated in (e) of FIG. 2, but also by transferring only the covering layer 4*b* from the covering-layer-forming material 6 onto an intermediate transfer roll (not illustrated) and thereafter transferring it from the Intermediate transfer roll onto the surface of the preformed covering layer 4*a* on the base material 2 side. If a pattern for the covering layer 4*b* to be transferred is formed on the surface of this transfer roll as in the case of offset printing, the covering layer 4 corresponding to the predetermined pattern can be formed on the surface of the ink receiving layer 3.

(b) of FIG. 3 shows another embodiment of the covering-layer-forming material 6, in which another function layer 10 as a layer having another function is provided between the covering layer 4*b* and the release layer 9 in the embodiment of the covering-layer-forming material 6 of (a) in FIG. 3. Since this another function layer 10 is not transferred directly onto the preformed covering layer 4*a* formed on the surface of the ink receiving layer 3, it can be made of a material different from the preformed covering layer 4*a* and the covering layer 4*b*. This another function layer 10 can be a layer with any function, which can be selected, for example, from a UV-cutting layer for preventing influence of ultraviolet rays, a hard coat layer for imparting hardness to the image recording sheet, a UV-cutting hard coat layer having the both foregoing functions, a weather-resistant layer for providing weather resistance, a solvent-resistant layer for providing solvent resistance, and so on. A material for the another function layer 10 to demonstrate these functions can be one species or a combination of several species of known resins, depending upon the substance of the function to be given. These resins include melamine resin, alkyd resin, acrylic resin, polyester base resin, fluororesin, silicone resin, acrylic silicone resin, and so on. Specifically, when the UV-cutting layer is provided as another function layer 10, the material of the UV-cutting layer can be selected, for example, from materials such as trade names: RUVA-93, PUVA-30M, etc. available from OTSUKA CHEMICAL CO. LTD. The thickness of this UV-cutting layer can be one enough to absorb ultraviolet rays so as to prevent fading of the ink, for example, approximately 2.5 $\mu$m. A further covering layer may also be formed as another function layer 10. In this case, by using a material with low minimum filming temperature (MFT) and glass transition point (Tg) as a first material for the preformed covering layer 4*a* and the covering layer 4*b* to be formed on the surface of the ink receiving layer 3, low-temperature transfer can be effected and adhesion strength of the preformed covering layer 4*a* and covering layer 4*b* can be enhanced; and the weather resistance can be improved by using a material with high minimum filming temperature (MFT) and glass transition point (Tg) as a second material for the covering layer to form the another function layer 10. An example of the first material with low minimum filming temperature (MFT) and glass transition point (Tg) is Part No. 240 of Vinyblan (trade name) available from Nisshin Kagaku K.K. as stated previously, and the thickness of the covering layer 4*b* is preferably about 10 $\mu$m. An example of the second material with high minimum filming temperature (MFT) and glass transition point (Tg) is Part No. 602 of Vinyblan (trade name) available from Nisshin Kagaku K.K. as stated previously, and the thickness of the another function layer 10 is preferably about 2 $\mu$m.

In the covering-layer-forming material 6 of each embodiment described above, recycling of material can be achieved so as to prevent environmental pollution by collecting the release sheet 7 after the transfer of the covering layer 4 and forming the covering layer 4 thereon again.

Since the base material 2 and release sheet 7 both are heated by the heat roll during the transfer of the covering layer 4, if they have different heat shrinkage rates the completed image recording sheet 1 will be curved so as to make the surface with a higher heat shrinkage rate concave; therefore, it is preferable to select materials having nearly equal heat shrinkage rates for them. For example, where the base material 2 is made of a material with a low heat shrinkage rate such as paper or the like, the release sheet 7 is preferably a resin film having a low heat shrinkage rate. Examples of resin films having low heat shrinkage rates are resins such as PET, PEN, PPS, PES, PAR, PA, PI, and so on having the low heat shrinkage property. These resin films of low heat shrinkage rates are enough to endure use under such circumstances that the surface temperature of the heat roll during the transfer is 140° C. and higher. If the surface temperature of the heat press roll during the transfer is about 120° C., standard PET films can be used instead of the aforementioned PET films having the low heat shrinkage property. When the base material 2 and release sheet 7 have different heat shrinkage rates, it is preferable to backcoat the back surface of either one of them with the latex or PVA or the like so as to make a combined heat shrinkage rate nearly equal to the heat shrinkage rate of the other.

In the present invention, the glossiness of the surface of the completed image recording sheet 1 can be adjusted by adjusting one or both of the thickness of the layer formed on the ink receiving layer 3 (the thickness of the covering layer 4 alone or the total thickness of the covering layer 4 and the another function layer 10) and the thickness of the release sheet 7. Namely, where the thickness of the release sheet 7 having a flat surface is not more than a predetermined value, the glossiness of the surface of the completed image recording sheet 1 will be the gloss of silver-salt photograph; if it is over the predetermined value the surface will have supergloss with much greater glossiness. If the thickness of the layer formed on the ink receiving layer 3 is not more than a predetermined value, the glossiness of the surface of the completed image recording sheet 1 will be the gloss of silver-salt photograph; if it is over the predetermined value the surface will have supergloss with much greater glossiness.

For example, using woodfree paper (157 g/m$^2$) as the base material 2, the latex as the material for the covering layer 4, and the PET film (available from TEIJIN LTD.: trade name Tetron S Type) as the release sheet 7, the glossiness of the surface of completed image recording sheets 1 with variations in the thicknesses of the covering layer 4 and release sheet 7 was investigated and the result thereof was as described in the following table.

| Thickness of | Thickness of latex | | |
|---|---|---|---|
| PET film | 15 $\mu$m | 8 $\mu$m | 4 $\mu$m |
| 100 $\mu$m | supergloss | supergloss | supergloss |
| 50 $\mu$m | supergloss | gloss of silver-salt photograph | gloss of silver-salt photograph |
| 38 $\mu$m | gloss of silver-salt photograph | gloss of silver-salt photograph | gloss of silver-salt photograph |

From this result, it is seen that the surface of the image recording sheet 1 has the supergloss when the thickness of the PET film as the release sheet 7 is not less than 50 $\mu$m and that it has the gloss of silver-salt photography when the thickness is not more than 38 $\mu$m. It is also seen that the surface of the image recording sheet 1 has the supergloss when the thickness of the latex as the material for the covering layer 4 is not less than 4 $\mu$m.

FIG. 4 shows still another embodiment of the present invention.

In each of the aforementioned embodiments the same material as the covering layer 4 is preliminarily formed on the ink receiving layer 3 in order to transfer the covering layer 4 onto the ink receiving layer 3, whereas in the present embodiment a transfer auxiliary layer 11 made of a material different from the ink receiving layer 3 and the covering layer 4 and congenial to the both is preliminarily formed as a thin film on either one or on the both of the opposite surfaces of the ink receiving layer 3 and covering layer 4 (see (a) and (b) of FIG. 4) and thereafter the covering layer is transferred as illustrated in (c) of FIG. 4. When the transfer auxiliary layer 11 is formed on the surface of the ink receiving layer 3 as illustrated in (a) of FIG. 4, it should be made possible to effect writing with the ink 8 into the ink receiving layer 3 through the transfer auxiliary layer 11. When the transfer auxiliary layer 11 is formed on the surface of the covering layer 4 as illustrated in (b) of FIG. 4, the writing with the ink 8 into the ink receiving layer 3 does not have to be taken into consideration.

When a transfer mechanism for transferring the covering layer 4 of the covering-layer-forming material 6 onto the ink receiving layer 3 is incorporated in a printer for forming the image in the ink receiving layer 3 with the ink 8 in order to carry out the present invention, the present invention can be applied at low cost by the apparatus of the simple structure.

It is noted that the present invention is by no means limited to the embodiments described above and can also involve various changes according to needs.

What is claimed:

1. A set of an image-recording sheet and a covering-layer-forming material, wherein the image-recording sheet comprising a base material and an ink-receiving layer on said base material;

the covering-layer-forming material comprising a release sheet and a covering layer covering said ink-receiving layer after formation of an image on said ink receiving layer and being formed on said release sheet; and a transfer-assist layer compatible with said covering layer and said ink-receiving layer, and formed on said covering layer or said ink-receiving layer.

2. The set according to claim 1, wherein said ink-receiving layer has a composition in which 10 to 300 parts by weight of a solid component are mixed per 100 parts by weight of a swelling resin component, and wherein said solid component has a maximum size equal to a half or less of a thickness of the ink-receiving layer, and an average grain size of 1 to 10 $\mu$m.

3. The set according to claim 2, wherein the solid component is silica.

4. The set according to claim 1, wherein the covering layer comprises latex.

5. A recording method comprising the steps of:

forming an image on the ink-receiving layer of the image-recording sheet according to claim 1; and applying and bonding covering-layer-forming material according to claim 1 onto the ink-receiving layer; and forming a covering layer through a transfer-assist layer on said ink-receiving layer.

6. A set of an image-recording sheet and a covering-layer-forming material, wherein the image-recording sheet comprising a base material and an ink-receiving layer on said base material;

the covering-layer-forming material comprising a release sheet and a covering layer covering said ink-receiving layer after formation of an image on said ink-receiving layer and being formed on said release sheet; and the image-recording sheet comprises further a transfer-assist layer which is formed from the same material as the covering sheet and which is disposed on the ink-receiving layer.

* * * * *

UNITED STATES PATENT AND TRADEMARK OFFICE

CERTIFICATE OF CORRECTION

PATENT NO. : 6,492,003 B1
DATED : December 10, 2002
INVENTOR(S) : Hiroshi Ochiai et al.

It is certified that error appears in the above-identified patent and that said Letters Patent is hereby corrected as shown below:

Title page,
Insert Item:
-- [86] PCT No: PCT/JP98/02067 --.
Item [57], ABSTRACT,
Line 12, “images” should read -- image --.

Column 1,
Line 42, “long time necessary” should read -- a long time being necessary --.
Line 48, “shoot” should read -- sheet --.
Line 58, “in” should read -- in the --.
Line 66, “as” should read -- is --.

Column 4,
Line 58, “in” should read -- in the --.
Line 66, “as” should read -- is --.

Column 5,
Line 62, “for” should read -- for an --.

Column 6,
Line 35, “Such” should read -- such --.

Column 8,
Line 58, “layer,” should read -- layer --.

UNITED STATES PATENT AND TRADEMARK OFFICE

CERTIFICATE OF CORRECTION

PATENT NO. : 6,492,003 B1
DATED : December 10, 2002
INVENTOR(S) : Hiroshi Ochiai et al.

It is certified that error appears in the above-identified patent and that said Letters Patent is hereby corrected as shown below:

Column 9,
Line 56, "Intermediate" should read -- intermediate --.

Signed and Sealed this

Seventeenth Day of February, 2004

JON W. DUDAS
*Acting Director of the United States Patent and Trademark Office*